United States Patent [19]

Ueda

[11] Patent Number: 4,590,734

[45] Date of Patent: May 27, 1986

[54] PACKAGING MACHINE

[75] Inventor: Kazuo Ueda, Tokyo, Japan

[73] Assignee: Shikoku Kakooki Co., Ltd., Tokushima, Japan

[21] Appl. No.: 616,647

[22] Filed: Jun. 4, 1984

[51] Int. Cl.[4] ..... B65B 3/02

[52] U.S. Cl. ..... 53/52; 53/167; 53/563; 141/87

[58] Field of Search ..... 53/141, 52, 167, 425, 53/426, 563, 565; 141/86, 87, 123, 311 A; 422/28, 302, 304

[56] References Cited

U.S. PATENT DOCUMENTS

| | | | |
|---|---|---|---|
| 548,123 | 10/1895 | Hagins | 141/87 |
| 3,566,575 | 3/1971 | Lisiecki | 53/426 |
| 4,375,145 | 3/1983 | Mosse et al. | 53/425 |
| 4,456,118 | 6/1984 | Kauffman et al. | 53/565 |

FOREIGN PATENT DOCUMENTS

| | | | |
|---|---|---|---|
| 8203832 | 11/1982 | European Pat. Off. | 53/425 |
| 2712020 | 9/1978 | Fed. Rep. of Germany | 422/302 |
| 2120765 | 8/1972 | France | 53/167 |

*Primary Examiner*—E. R. Kazenske
*Assistant Examiner*—Michael D. Folkerts
*Attorney, Agent, or Firm*—Armstrong, Nikaido, Marmelstein & Kubovcik

[57] ABSTRACT

A packaging machine comprising an endless conveyor, a mandrel wheel disposed above the starting end of the path of transport of the conveyor and having mandrels, a closed main chamber enclosing the conveyor and the mandrel wheel entirely, a series of devices arranged on the top wall of the main chamber from the rear to the front in succession for making tubular blanks into containers by closing one end of each blank to form the bottom of the container, filling contents into the bottomed blank and thereafter closing the other end of the blank to form the top of the container, the series of devices having portions operative on the blank and extending into the main chamber, and a closed subchamber disposed to the rear of the main chamber and communicating therewith, the subchamber having installed therein a blank sterilizer and a blank transfer assembly for transferring tubular blanks from a blank shaping-feeding unit to the blank sterilizer and for transferring sterilized tubular blanks from the sterilizer to the mandrel wheel. The device for filling contents into the bottomed blank includes a filling nozzle and a liquid conduit disposed therebelow which is rotatably mounted so as to be able to be positioned to receive contents passed through the filling nozzle.

10 Claims, 14 Drawing Figures

PACKAGING MACHINE

The present invention relates to a packaging machine, and more particularly to a machine for closing one end of a tubular blank to form the bottom of a container, filling a liquid food or like contents into the container and thereafter closing the other end of the blank to form the top of the container and complete a sealed container with the contents placed therein.

In general, it is strictly required that machines for handling foods be maintained in sanitary conditions. For this purpose, packaging machines are known which are adapted to perform a series of packaging operations within a closed chamber having a required space separated from the atmosphere.

However, such machines have the following drawbacks. The blanks to be made into containers are contaminated with microorganisms and therefore need to be sterilized, but it is difficult to sterilize the blanks within the chamber because the chamber is of closed construction. The interior of the chamber becomes contaminated with the microorganisms adhering to the blanks when the blanks are transported into the chamber.

An object of the present invention is to assure a series of packaging operations wherein blanks can be sterilized completely and which are carried out in a completely sterilized space.

The present invention provides a packaging machine which comprises an endless conveyor, a mandrel wheel disposed above the starting end of the path of transport of the conveyor and having a plurality of mandrels, a closed main chamber enclosing the conveyor and the mandrel wheel entirely, a series of devices arranged on the top wall of the main chamber from the rear to the front in succession for making tubular blanks into containers by closing one end of each blank to form the bottom of the container, filling contents into the bottomed blank and thereafter closing the other end of the blank to form the top of the container, the series of devices having portions operative on the blank and extending into the main chamber, and a closed subchamber disposed to the rear of the main chamber and communicating therewith, the subchamber having installed therein a blank sterilizer and a blank transfer assembly for transferring tubular blanks from a blank shaping-feeding unit to the blank sterilizer and for transferring sterilized tubular blanks from the sterilizer to the mandrel wheel.

According to the present invention, tubular blanks, before being supplied to the main chamber for a series of packaging operations, are fed to the subchamber which is separate from the main chamber, are then sterilized in the subchamber and are thereafter fed to the main chamber. This assures complete sterilization of the blanks, which will not contaminate the main chamber when transported thereinto.

With reference to the accompanying drawings, an embodiment of the invention will be described below merely for illustrative purposes.

The packaging machine to be described below comprises two rows of components, and the components of one row are identical with those of the other row. Throughout the drawings, like parts are referred to by like reference numerals.

The packaging machine is adapted for use with tubular paper blanks for packaging. A thermoplastic synthetic resin layer is formed on the inner and outer sides of each blank.

Figure 1:
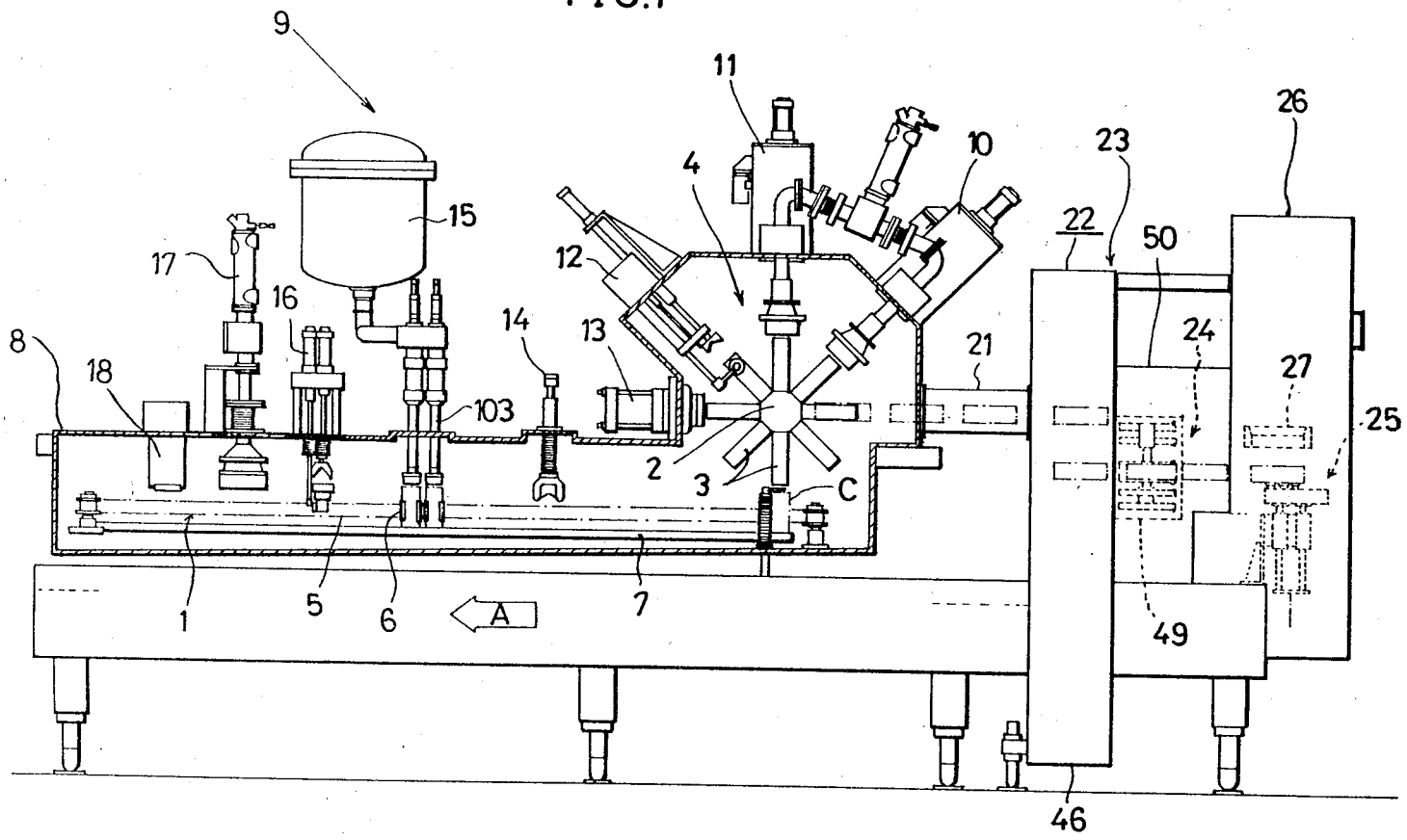
FIG. 1 and FIG. 2 are a side elevation and a front view, respectively, of a packaging machine.
Figure 2:
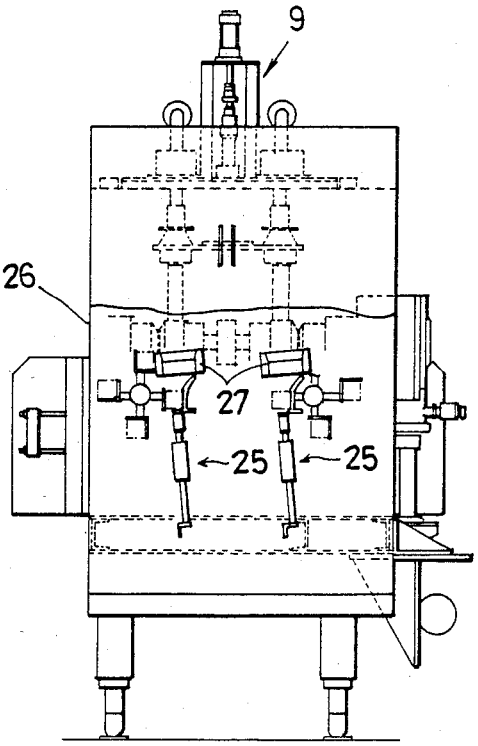

With reference to FIGS. 1 and 2, the packaging machine comprises an endless conveyor 1 and a mandrel wheel 4 disposed above the starting end of the path of transport of the conveyor 1 and having a horizontal rotary shaft 2 and eight mandrels 3 extending radially from the shaft 2. The conveyor 1 and the mandrel wheel 4 are intermittently driven in synchronism. Although not shown in detail, the conveyor 1 comprises a pair of chains 5 movable in circulation in a horizontal plane, a multiplicity of holders 6 attached to the chains 5 at a predetermined spacing and a rail 7 for supporting the bottoms of bottomed tubular blanks C. The blanks C are transported by the conveyor 1 from the rear forward as indicated by an arrow A. The mandrel wheel 4 is driven counterclockwise in FIG. 1. The conveyor 1 and the mandrel wheel 4 are entirely enclosed in a closed main chamber 8. The main chamber 8 is filled with clean air which has been so sterilized as to assure substantially effective life of the product. A series of devices 9 are arranged on the top wall of the main chamber 8 from the rear forward in succession. These devices include primary and secondary bottom heaters 10, 11 for heating the end of the tubular blank C to be made into the bottom of a container, a bottom breaker 12 for folding the end to a flat form, a bottom sealer 13 for pressing the flatly folded end, a primary top breaker 14 for forming folds in the other end of the tubular blank C so as to render the end easily foldable into a roof form to provide the top of the container, a filling device 15 for filling a predetermined amount of contents into the bottomed tubular blank C, a secondary top breaker 16 for eventually folding the end in the form of a roof along the folds formed by the primary top breaker 14, a top heater 17 for heating the end thus folded and a top sealer 18 for pressing the end. Of these devices, the primary and secondary bottom heaters 10, 11, the bottom breaker 12 and the bottom sealer 13 are arranged at the positions where the mandrels stop. The portions of the group of devices 9 which operate on the blank C extend into the main chamber 8. The wall portions of the main chamber 8 through which these operating portions of the devices extend into the main chamber are completely prevented from passing air therethrough with use of bellows for the operating portion which performs a reciprocating rectilinear motion or with use of an oil seal or mechanical seal for the operating portion which performs a rotary motion. The series of devices 9 are all those already known. The main chamber 8 is internally provided with a cleaning-sterilizing system 19 and a clean air supplying system 20.

A closed subchamber 22 is disposed to the rear of the main chamber 8 and made to communicate therewith by a booth 21. A blank sterilizer 23 and a blank transfer assembly 24 are arranged within the subchamber 22. A blank shaping-feeding unit 25 is provided outside the subchamber 22. The blank shaping-feeding unit 25 is enclosed in its entirety in a rear chamber 26 which, however, is not of closed construction unlike the chambers 8 and 22. The unit 25, which is of the known type, is adapted to shape folded flat blanks C into a tubular form. The unit 25 includes a magazine 27 having stacked therein a multiplicity of folded flat blanks C although not shown. As will be described later in detail, the blank transfer assembly 24 is adapted to transfer blanks C shaped to a tubular form from the blank shaping-feeding unit 25 to the blank sterilizer 23 and to transfer sterilized tubular blanks C from the sterilizer 23 to the mandrel wheel 4.

Figure 3:
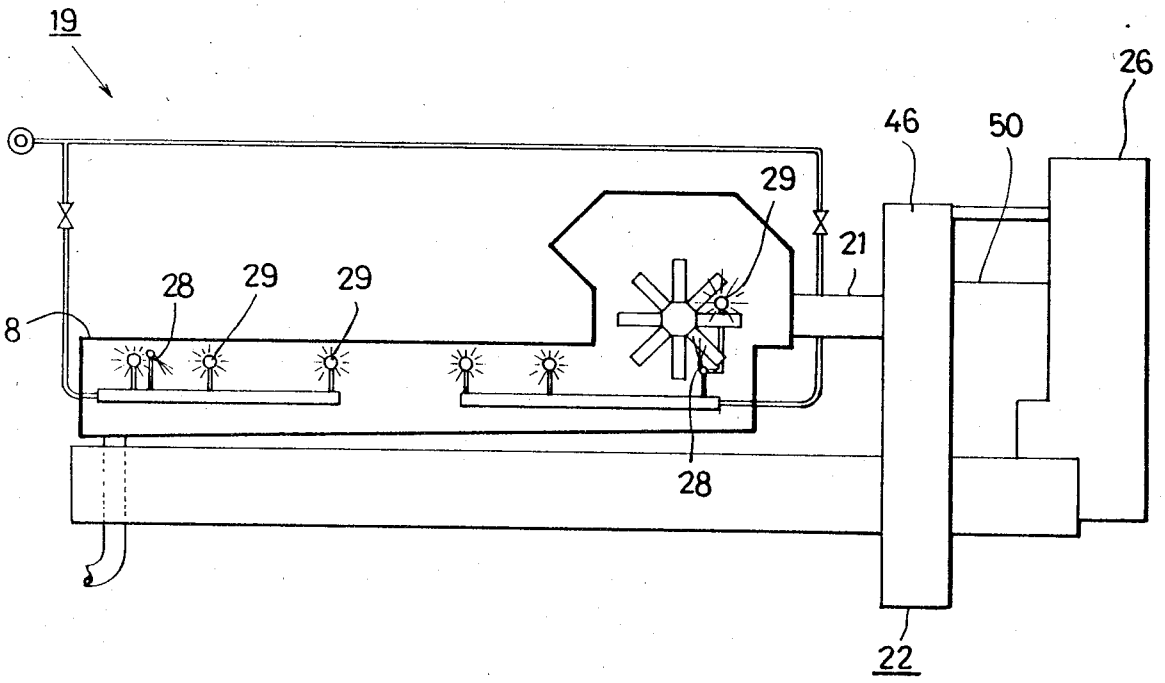
FIG. 3 and FIG. 4 are side elevations showing the arrangement of a chamber cleaning-sterilizing system.
Figure 4:
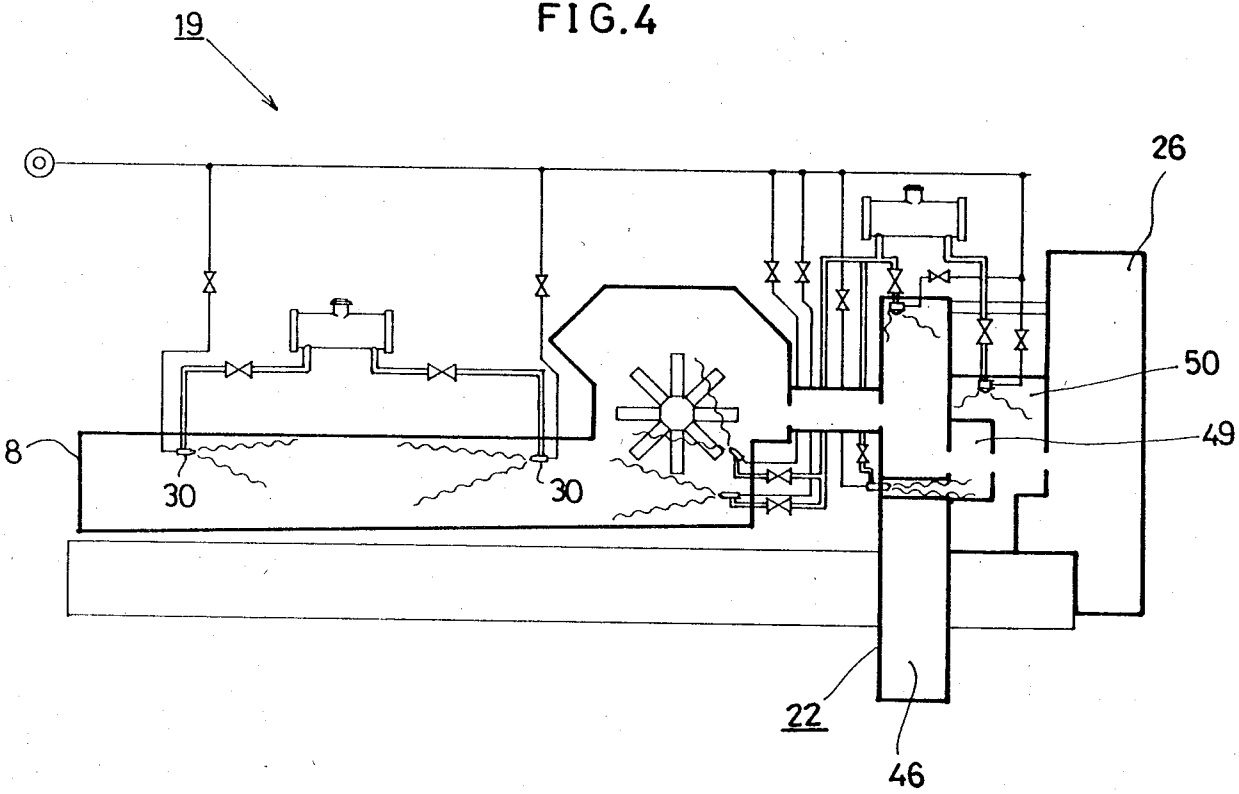

As seen in FIGS. 3 and 4, the cleaning-sterilizing system 19 comprises spray nozzles 28, spray balls 29 and sterilizing solution spray nozzles 30 which are arranged within the main chamber 8 as required. The conveyor 1 is operated with a cleaning solution forced out from the spray nozzles 28 and balls 29, whereby the conveyor 1 and the interior of the main chamber 8 can be cleaned automatically. A sterilizing solution, when applied by the spray nozzles 30, sterilizes the conveyor 1 and the interior of the main chamber 8. An aqueous solution of hydrogen peroxide with a concentration of 35% is used as the sterilizing solution.

Figure 5:
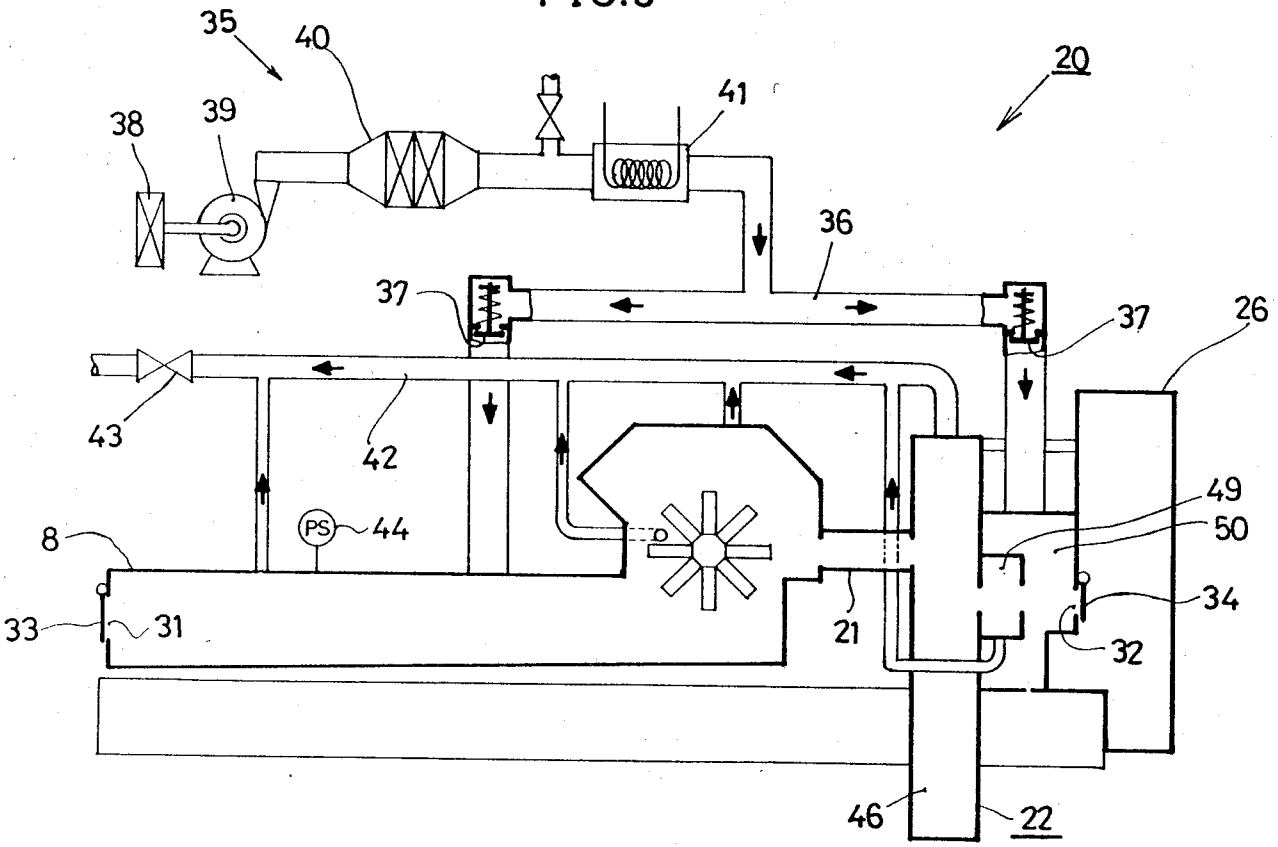
FIG. 5 is a side elevation showing the arrangement of a clean air supplying system.

FIG. 5 shows the clean air supplying system 20. The main chamber 8 has a completed container discharge opening 31 at the front end thereof. The subchamber 22 has a blank supply opening 32 at a rear portion thereof. These openings 31 and 32 are provided with openable closures 33 and 34 respectively. Branched air supply ducts 36 extending from an air supply unit 35 are connected to the main chamber 8 and the subchamber 22 and are each provided with a check valve 37. The air supply unit 35 comprises an air intake filter 38, an electric blower 39, a sterilizing filter 40 and a heater 41. An air discharge duct 42 is connected to suitable portions of the main chamber 8 and the subchamber 22 and is open to the atmosphere through a shutoff valve 43. The system 20 is further provided with a pressure sensor 44 for detecting the internal pressure of the main chamber 8, such that when the pressure detected drops below a set level, the air supply unit 35 operates in response to an output signal from the sensor 44. Although not shown in FIG. 5, the air supply duct 36 is also connected to the blank sterilizer 23 (see FIGS. 6 to 8).

During steady-state operation, clean air is fed to the chambers 8 and 22 at all times from the air supply unit 35 to maintain the interior of the chambers at a positive pressure, whereby outside air is prevented from flowing into the chambers 8 and 22 to avoid contamination that would otherwise occur. While the machine is out of operation, for example, during nighttime, the closures 33, 34 and the shutoff valve 43 on the discharge duct 42 are closed, whereby the interior of the chambers 8, 22 can be maintained at a possitive pressure even if the air supply unit 35 is held out of operation, since the supply ducts 36 are automatically closed by the check valves 37. The supply ducts 36 are shut off from the chambers 8, 22 by the check valves 37 and separated from the atmosphere by the sterilizing filter 40, so that the ducts 36 are made free from contaminants. This eliminates the need for routine sterilization of the supply ducts 36. If the internal pressure of the chambers 8, 22 decreases for one cause or another, the sensor 44 detects the pressure drop to operate the electric blower 39 and to thereby maintain the interior of the chambers 8, 22 at the specified positive pressure level at all times.

Figure 6:
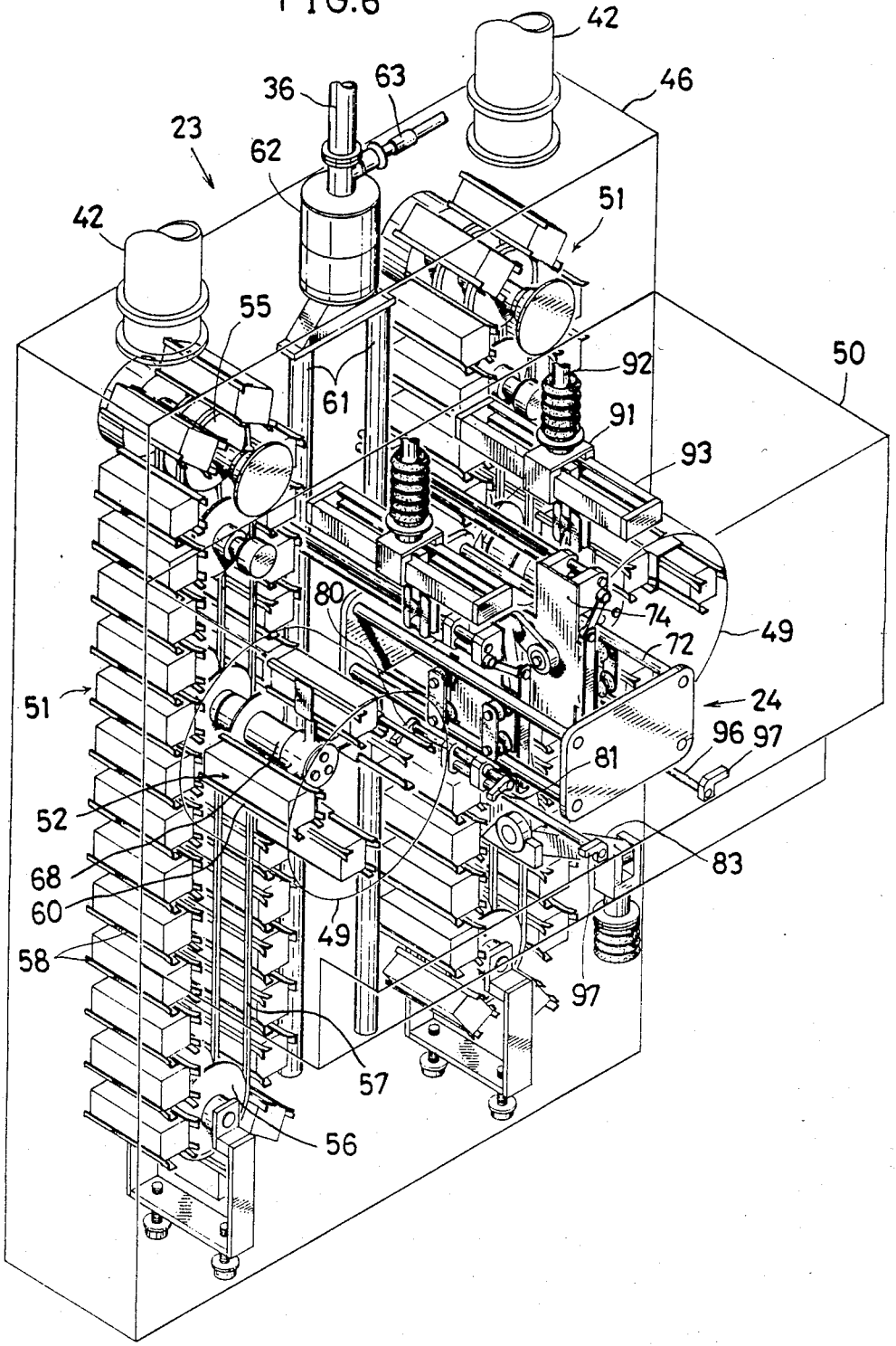
FIG. 6 is a perspective view of the interior of a subchamber to show a blank sterilizer and a blank transfer assembly.
Figure 7:
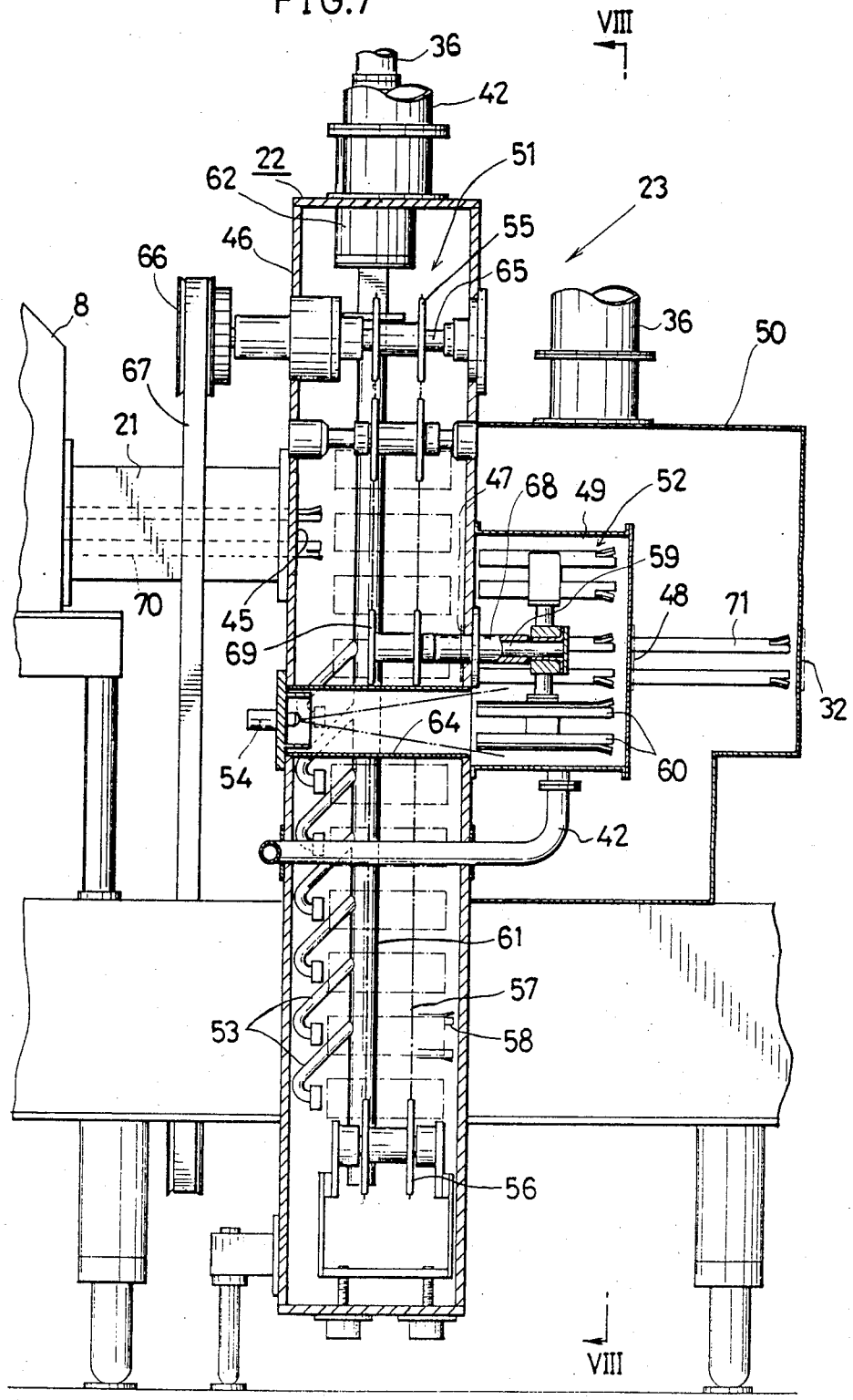
FIG. 7 is an enlarged view in vertical section of the subchamber to show the blank sterilizer.
Figure 8:
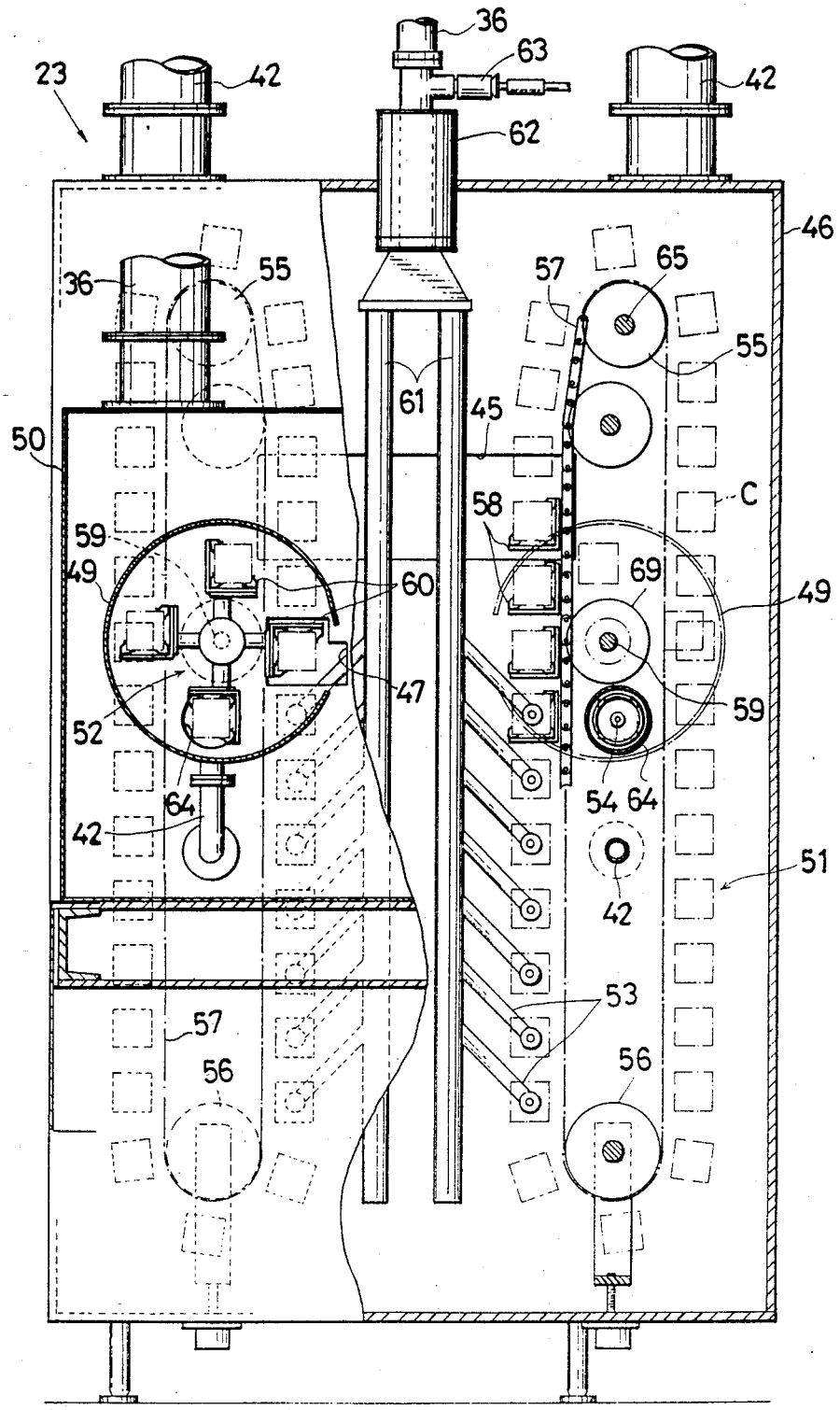
FIG. 8 is a view in section taken along the line VII—VII in FIG. 7.

FIGS. 6 to 8 show the subchamber 22 and the blank sterilizer 23 in detail.

The subchamber 22 comprises a drying compartment 46 having at its front portion a blank outlet 45 communicating with the main chamber 8, a sterilizing compartment 49 communicating at its front portion with the drying compartment 46 through an opening 47 and having a blank inlet 48 at its rear portion, and a pressurized compartment 50 enclosing an opening, including the blank inlet 48, of the sterilizing compartment 49. The drying compartment 46 is in the form of a flat case having a thickness in the front-to-rear direction and is formed with the blank outlet 45 in its front wall. The air supply duct 36 and the air discharge duct 42 are connected to the top wall of the drying compartment 46. The sterilizing compartment 49 is in the form of a bottomed horizontal hollow cylinder having an open front end which is attached to the rear wall of the drying compartment and thereby closed. The blank inlet 48 is positioned to the rear of the communication opening 47 in alignment therewith. The pressurized compartment 50 is in the form of a case open at its front end and having such a size as to cover the sterilizing compartment 49 with a required space formed therein around the compartment 49. Like the sterilizing compartment 49, the open end of the pressurized compartment 50 is intimately attached to and closed by the rear wall of the drying compartment 46. The aforementioned blank supply opening 32 is formed in the rear wall of the compartment 50. The air supply duct 36 is also connected to the top wall of the pressurized compartment 50.

The blank sterilizer 23 comprises a drying conveyor 51 disposed within the drying compartment 46, a sterilizing conveyor 52 disposed within the sterilizing compartment 49, hot air blowing nozzles 53 arranged along the path of transport of the drying conveyor 51, and a blank sterilizing spray nozzle 54 directed toward the path of transport of the sterilizing conveyor 52.

The drying conveyor 51 comprises drive and driven sprockets 55, 56 having axes of rotation spaced apart by a predetermined distance one above the other and extending in the front-to-rear direction, endless chains 57 reeved around the sprockets 55, 56 and a multiplicity of drying blank holders 58 attached to the endless chains 57 at a predetermined spacing. The drying conveyor 51 is so disposed within the drying compartment 46 that each of the holders 58 travels passing positions opposed to the blank outlet 45 and the communication opening 47. The sterilizing conveyor 52 comprises a horizontal rotary shaft 59 extending in the front-to-rear direction and four sterilizing blank holders 60 attached to the rotary shaft 59 and arranged around the rotary shaft at a predetermined spacing. The sterilizing conveyor 52 is so disposed within the sterilizing compartment 49 that each of the holders 60 travels passing a position opposed to the communication opening 47 and the blank inlet 48. Both the drying and sterilizing blank holders 58 and 60 are of the same shape and comprise a plurality of horizontal pieces to be positioned around the tubular blank C to retain the blank C in a horizontal position, restraining the blank from upward or downward movement but allowing the blank to move forward or rearward.

The hot air blowing nozzles 53 are attached to a hot air supply duct 61 extending vertically within the drying compartment 46 and are arranged at the same spacing as the drying blank holders 58. The orifices of the nozzles 53 are directed in the axial direction of the holders 58. The upper end of the duct 61 extends through the top wall of the drying chamber 46 upward, with a heat insulating tube 62 provided around the duct 61. The top end of the duct 61 has the air supply duct 36 connected thereto and a burner 63 attached thereto.

The nozzle 54 for spraying a solution for sterilizing the blank is mounted on the bottom of a bottomed tube 64. The tube 64 extends in the front-to-rear direction across the drying compartment 46 so as to be positioned in front of and in alignment with each of the sterilizing blank holders 60 when the holder 60 depends from the rotary shaft 59. The tube 64 is provided in the drying compartment 46 with its open end communicating with the sterilizing compartment 49. Thus the orifice of the spray nozzle 54 is oriented in the axial direction of the blank holder 60.

The drive sprockets 55 of the drying conveyor 51 are fixed to a rotary shaft 65 extending from the rear wall of the drying compartment 46 forward through the front wall thereof. A pulley 66 is fixedly mounted on the end of the shaft 65 projecting outward from the compartment 46. A belt 67 is reeved around the pulley 66 and another pulley fixed to the output shaft of an unillustrated prime mover. The drying conveyor 51 is intermittently driven by the belt 67 so that the holders 58 thereon can be stopped at the positions opposed to the blank outlet 45 and the communication opening 47. On the other hand, the horizontal rotary shaft 59 of the sterilizing conveyor 52 is supported by a tube 68 attached to the rear end of the drying compartment 46. The front end of the rotary shaft 59 extends into the drying compartment 46, and drive sprockets 69 are fixed to the front end. The sprockets 69 are in mesh with the endless chains 57 so that the holders 60 of the sterilizing conveyor 52 can be stopped at the position opposed to the communication opening 47 and the blank outlet 48. Thus the sterilizing conveyor 52 is intermittently driven in synchronism with the drying conveyor 51. The drive interval is 90 degrees in terms of the revolution of the holders 60, i.e. one pitch of the holders 60. A blank guide 70 provided within the booth 21 in front of the drying compartment 46 is opposed to the blank outlet 45 of the compartment 46, while a blank guide 71 is provided within the pressurized compartment 50 and positioned in the rear of and opposed to the blank inlet 48 of the sterilizing chamber 49. The blank guides 70, 71 are generally identical with the blank holders 58, 60 in shape.

The air discharge duct 42 extending through the drying compartment 46 and the pressurized compartment 50 is connected to a lower portion of the sterilizing compartment 49. The interior of the pressurized compartment 50 is maintained at a higher pressure than the interior of the sterilizing compartment 49 because clean air is rapidly fed to the pressurized compartment 50 through the air supply duct 36 and further because air is rapidly discharged from the sterilizing compartment 49 via the air discharge duct 42. Accordingly the air within the sterilizing compartment 49 will not flow out into the pressurized compartment 50, and the sterilizing solution sprayed into the compartment 49 is discharged with the air discharged via the duct 46. This prevents air pollution with the sterilizing solution.

Figure 9:
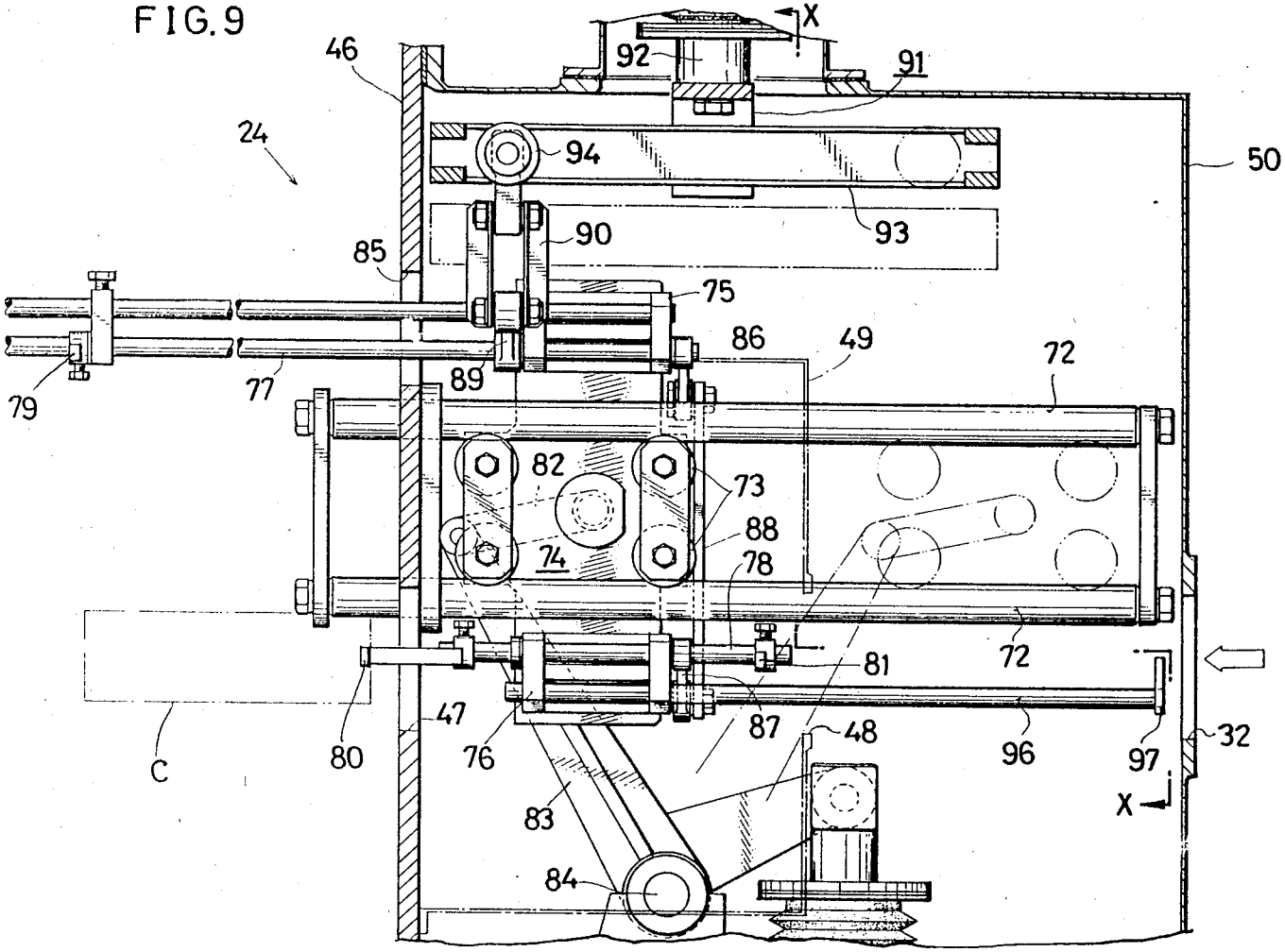
FIG. 9 is an enlarged view in vertical section of the subchamber to show the blank transfer assembly.
Figure 10:
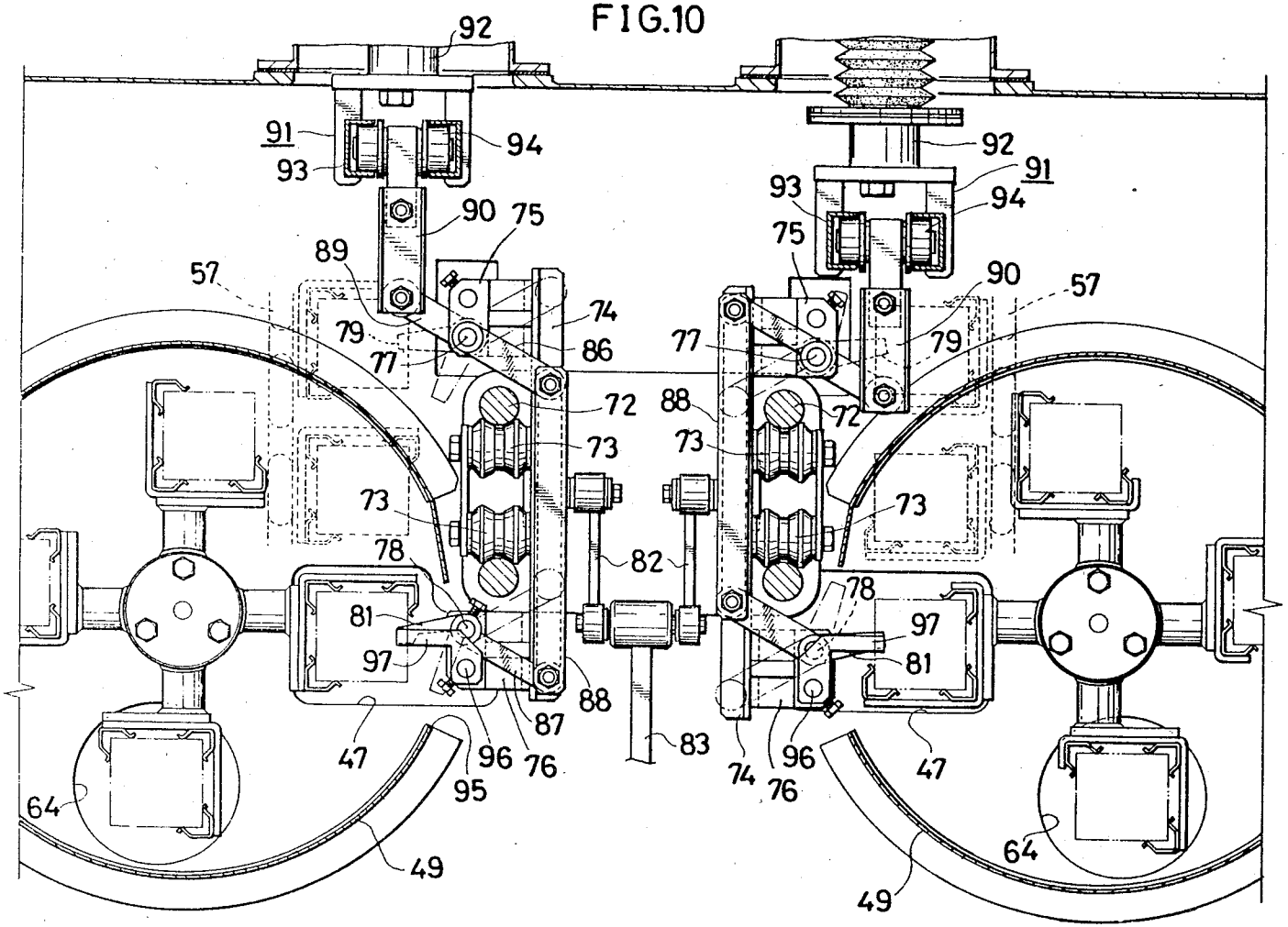
FIG. 10 is a view in section taken along the line IX—IX in FIG. 9.
Figure 11:
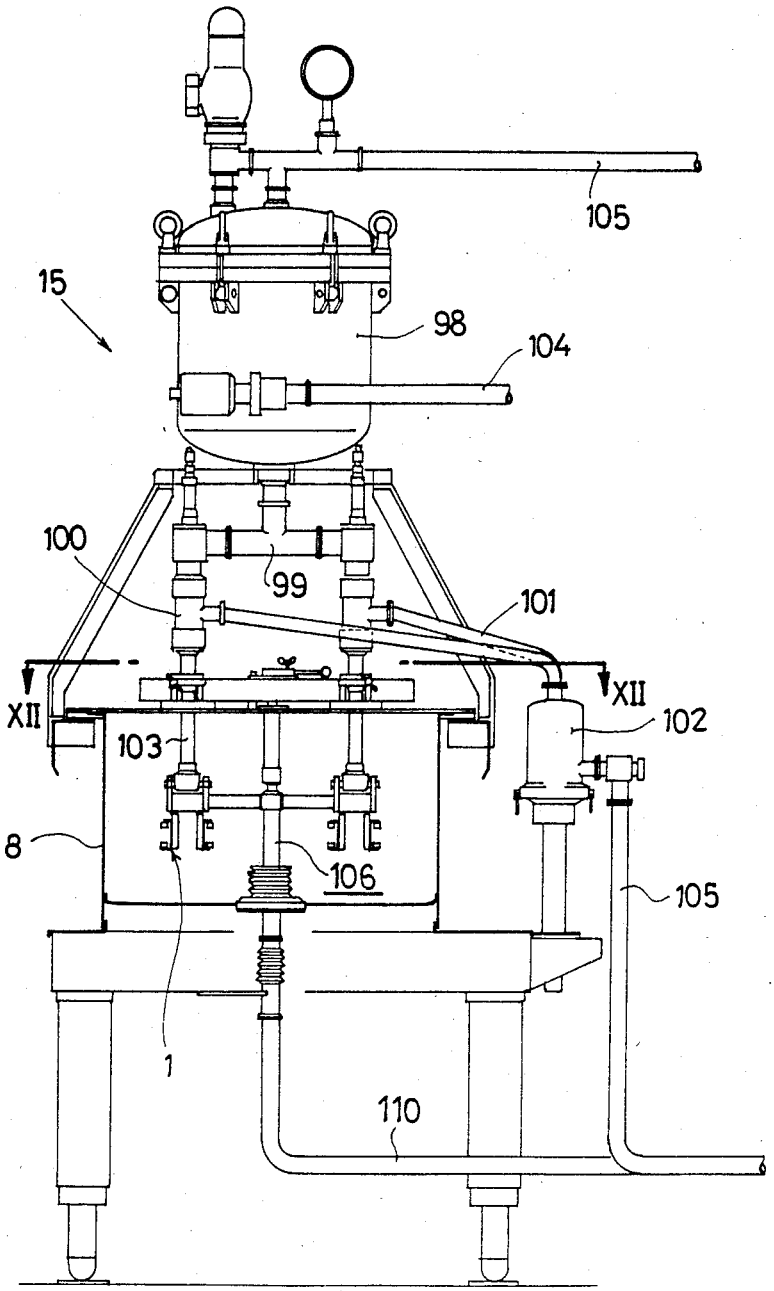
FIG. 11 is an enlarged view in vertical cross section of the main chamber showing a filling device.
Figure 12:
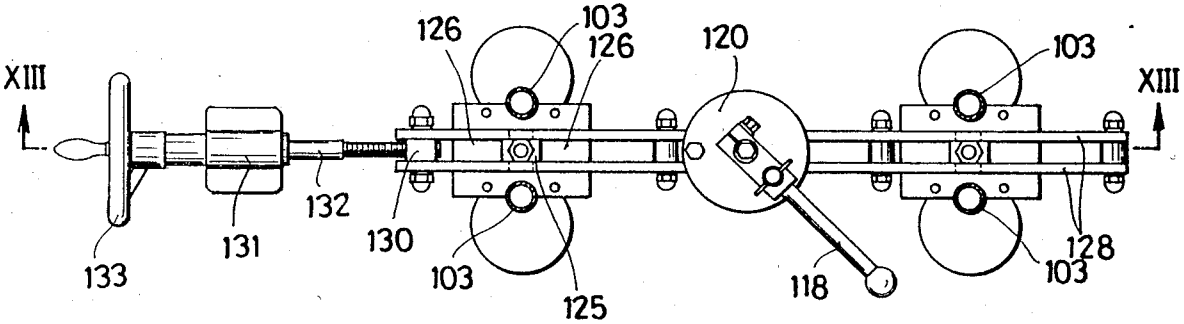
FIG. 12 is a view in section taken along the line XII—XII in FIG. 11.

FIGS. 6, 9 and 10 show the blank transfer assembly 24 in detail.

The blank transfer assembly 24 comprises a pair of upper and lower horizontal guide rods 72 extending in the front-to-rear direction at one side of the sterilizing compartment 49 within the pressurized compartment 50, a carriage 74 movably supported by rollers 73 on the guide rods 72, a pair of upper and lower pawl rods 77, 78 extending in the front-to-rear direction, rotatably supported by brackets 75, 76 on the carriage 74 and spaced apart by a predetermined distance from each other in parallel, an upper pawl 79 fixed to the upper pawl rod 77, and first and second lower pawls 80, 81 fixed to the lower pawl rod 78 and spaced apart from each other by a predetermined distance in the front-to-rear direction.

The horizontal guide rods 72 are supported, in the vicinity of their front ends, by the rear wall of the drying compartment 46 in a cantilever fashion. The forward end of a drive arm 83 is connected to the carriage 74 by a link 82. The drive arm 83 is supported by a transverse horizontal shaft 84. The drive arm 83, when pivotally moved by unillustrated means, moves the carriage 74 forward and rearward in reciprocation along the guide rods 72. A major portion of the upper pawl rod 77 extends into the drying compartment 46 through a hole 85 formed in the rear wall of the compartment 46. The upper and lower pawl rods 77, 78 are interconnected by a pair of arms 86, 87 and a link 88 so as to transmit rotation to each other. An operating arm 89 extending obliquely upward is secured to the front end of the arm 86 attached to the upper pawl rod 77. Lift means 91 is connected to the arm 89 by a connecting member 90. The lift means 91 comprises a lift rod 92, a pair of opposed horizontal guide rails 93 fixed to the lower end of the lift rod 92 and extending in the front-to-rear direction, and a trolley 94 supported by the rails 93. The lift rod 92 is movable upward and downward by an unillustrated cylinder. When the lift rod 92 is moved upward or downward along with the rail 93 and the trolley 94, the operating arm 89 is pivotally moved through the connecting member 90, whereby the upper pawl rod 77 is rotated. The rotation of the upper pawl rod 77 is transmitted to the lower pawl rod 78 via the pair of arms 86, 87 and the link 88. When the upper and lower pawl rods 77, 78 are both rotated, the upper pawl 79, the first lower pawl 80 and the second lower pawl 81 secured to these rods pivotally move between the horizontal position and the downward position indicated in solid lines or broken lines in FIG. 10. The peripheral wall of the sterilizing compartment 49 is formed with an aperture 95, through which the first and second lower pawls 80 and 81 are movable into the sterilizing compartment 49. When the pawls 79, 80 and 81 are pivotally moved, these pawls are engageable with blanks C. Stated more specifically, the upper pawl 79 is engageable with or disengageable from the blank C held by the drying blank holder 58 which is at rest in the position opposed to the blank outlet 45 of the drying compartment 46. The first lower pawl 80 is engageable with or disengageable from the blank C held by the sterilizing blank holder 60 which is at rest as opposed to the communication opening 47 and to the blank inlet 48. The second lower pawl 81 is engageable with or disengageable from the blank C which is to be held by the sterilizing blank holder 60. The last-mentioned blank C is retained by the blank guide 71 within the pressurized compartment 50. Although not shown, another pawl is secured to the upper pawl rod 77 to the front of the upper pawl 79. This pawl serves to forward the blank C which has been removed from the drying blank holder 58 by the upper pawl 79. This blank C is sent forward by being guided by the blank holder 70 within the booth 21. The carriage 74 further has a horizontal rod 96 extending rearward therefrom under the lower pawl rod 78 and fixedly provided with an engaging peice 97 at its rear end. The blank C which has been forwarded from the blank shaping-feeding unit 25 is brought by the engaging piece 97 into the range of stroke of the second lower pawl 81, i.e. to the position where it is to be held by the blank guide 71. The blank C shaped into a tubular form by the unit 25 is sent forward by the engaging piece 97 and the second lower pawl 81 and held by one of the sterilizing blank holders 60. At this time, the holder 60 is at rest on a horizontal line through the horizontal rotary shaft 59. When the sterilizing conveyor 52 is driven by one pitch, the same blank C is brought to a position opposed to to spray nozzle 54 in alignment therewith and is exposed to a spray of sterilizing agent from the nozzle 54, whereby the blank is uniformly sterilized over the inner and outer surfaces thereof. Subsequently the conveyor 52 is driven by three pitches, whereby the sterilized blank C is moved round the shaft 59 and returned to the original position within the compartment 49. When at rest in this position, the blank is forwarded by the first lower pawl 80 and is thereby removed from the holder 60 and held by one of the drying blank holders 58. Another blank C is placed by the second lower pawl 81 onto the sterilizing blank holder 60 from which the above blank C has been withdrawn. The blank C held by the drying blank holder 58 is sterilized and dried by the hot air blowing nozzles 53 during travel through the drying compartment 46. When the same blank C is brought to a halt at a position two piteches preceding the initial position after travelling through the drying compartment 46, the blank is removed from the sterilizing blank holder 58 and sent forward by the upper pawl 79. The blank C thus withdrawn from the holder 58 is further forwarded as retained on the blank guide 70 and fed to the main chamber 8.

FIGS. 11 to 14 show the filling device 15.

The filling device 15 comprises a filling liquid tank 98, a filling cylinder 100 connected at its upper end to the bottom of the liquid tank 98 by a branch pipe 99 so as to communicate with the tank 98, a metering cylinder 102 connected to an intermediate portion of the filling cylinder 100 between its upper and lower ends by a connecting pipe 101, and a filling nozzle 103 connected to the lower end of the filling cylinder 100.

A liquid supply pipe 104 is connected to the liquid tank 98. A cleaning solution supply pipe 105 extending from the cleaning-sterilizing system 19 is connected to the liquid tank 98 and to the metering cylinder 102. The filling nozzle 103 extends into the main chamber 8 through the top wall thereof and has an open lower end which is positioned immediately above the path of transport of blanks. Filling operation is conducted twice for each bottomed tubular blank C, so that two adjacent front and rear filling nozzles 103 are arranged along the transport path.

Figure 14:
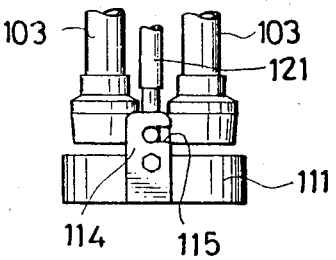
FIG. 14 is a view showing part of the device as it is seen along the arrows XIV—XIV in FIG. 13.

A liquid conduit 106 is disposed under the filling nozzles 103 within the main chamber 8. The liquid conduit 106 comprises a vertical portion 107 rotatably and vertically movably supported by the main chamber 8 at a location a predetermined distance sidewise away from immediately below the filling nozzles 103, and a horizontal portion 108 integral with the vertical portion 107 and having a length corresponding to the above-mentioned distance. The lower end of the vertical portion 107 extends outward from the main chamber 8 through its bottom wall, with a tubular seal member 109 fitted in the wall around the lower end. A liquid discharge pipe 110 is connected to the seal member 109. A liquid receptacle 111 is attached to the forward end of the horizontal portion 108. The liquid receptacle 111 is formed with two upwardly open nozzle sockets 112 corresponding to the two adjacent filling nozzles 103 and communicating with the liquid conduit 106. An annular seal member 113 of elastic material is attached to the inner periphery of each socket 112. A pair of opposed engaging pieces 114 projecting upward are attached to opposite sides of the liquid receptacle 111. A laterally U-shaped cutout 115 is formed in each engaging piece 114 as seen in FIG. 14. A rotating rod 116 is connected to the upper end of the vertical portion 107 of the conduit 106 in alignment with the portion 107. The rotating rod 116 slidably extends through and projects upward from a guide tube 117 attached to the top wall of the main chamber 8. A handle 118 is attached to the projecting end of the rod 116. The handle 118 is supported by the top wall of the main chamber 118 by means of a vertical solid cylindrical spacer 119 upstanding from the chamber 8 and a horizontal contact disk 120 fixed to the upper end of the spacer. The handle 118, when rotated, causes the rotating rod 116 and the liquid conduit 106 to revolve the liquid receptacle 111 in a horizontal plane.

Figure 13:
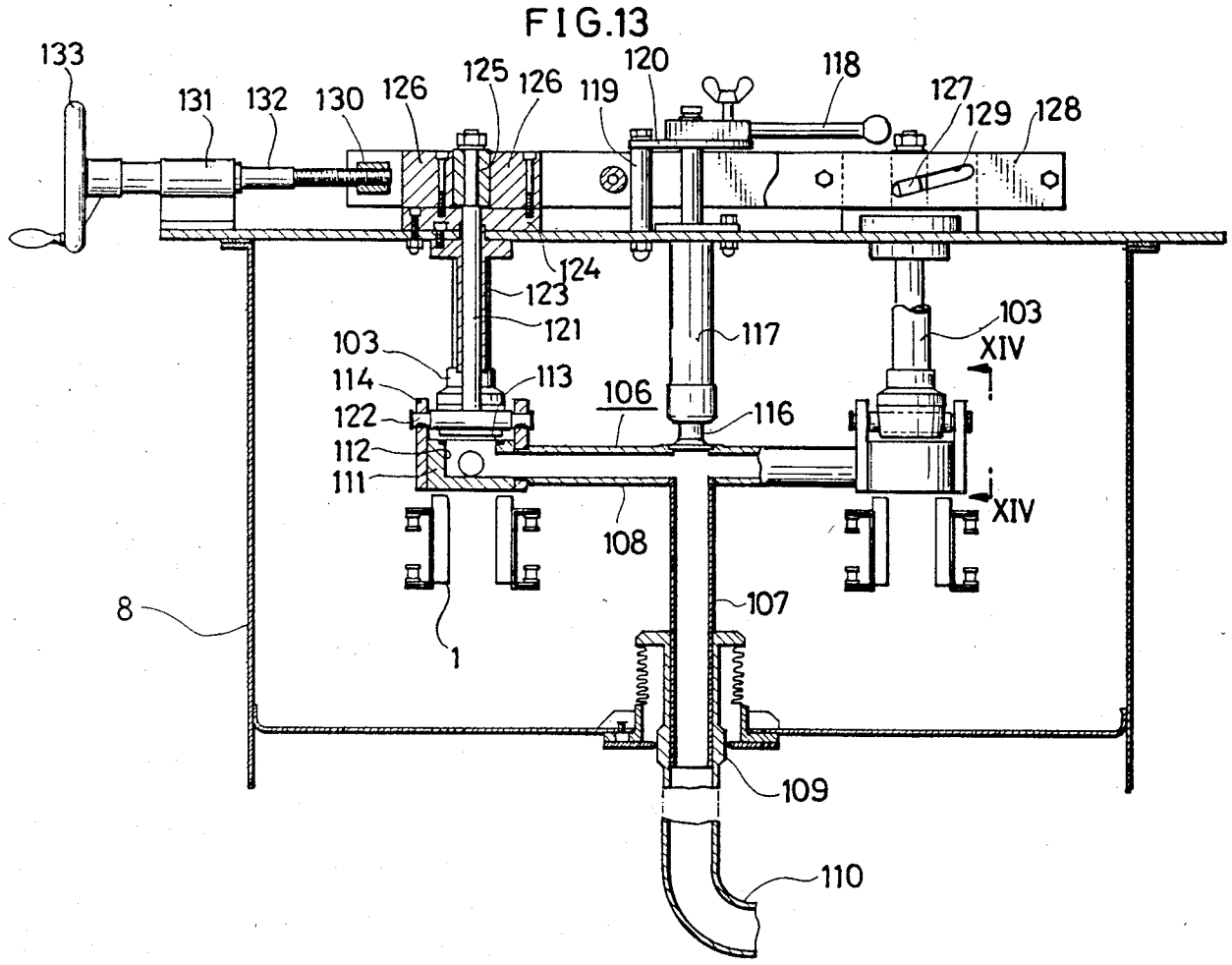
FIG. 13 is a view in section taken along the line XIII—XIII in FIG. 12.

The filling nozzles 103 are provided with a vertically movable rod 121 extending upward from their lower ends. The lower end of the rod 121 is integral with an engaging member 122 extending horizontally laterally. The vertically movable rod 121 is slidably inserted through a guide tube 123 attached to the top wall of the main chamber 8, further slidably extends through a slide guide plate 124 mounted on the upper side of the top wall of the main chamber 8 immediately above the tube 123 and has its upper end projected upward beyond the plate 124. A rectangular tube 125 is held to the projecting end. The lateral opposite sides of the rectangular tube 125 are in bearing contact with a pair of blocks 126 having the same front-to-rear thickness as the tube 125 and adapted for guiding vertical movement. A projection 127 is integral with each of the front and rear sides of the rectangular tube 125. The tube 125 and the guide blocks 126 on opposite sides thereof are held between a pair of front and rear movable plates 128 which are rectangular and laterally elongated and which are laterally movably placed on the slide guide 124, the movable plates 128 being slidable on the front and rear surfaces of the tube 125 and the blocks 126. Each movable plate 128 is formed with a slot 129 having the projection 127 fitted therein. The slot 129 is slanted upwardly rightward as seen in FIG. 13. A threaded member 130 is held between the two movable plates 128 at one side of the chamber 8. A screw rod 132 supported by a bearing 131 on the top wall of the main chamber 8 has its one end screwed in the threaded member 130. A rotary handle 113 is attached to the other end of the screw rod 132.

During the steady-state filling operation, the horizontal portion 108 of the liquid conduit 106 is oriented in the front-to-rear direction so as not to interfere with the blanks C transported on the endless conveyor 1.

When the filling liquid is to be replaced by a different liquid after completion of the filling operation, the liquid receptacle 111 is revolved in the manner already described and positioned immediately below the open lower ends of the filling nozzles 103, whereby the engaging pieces 114 are fitted at the cutouts 115 to the engaging member 112 of the vertically movable rod 121. Thus the liquid receptacle 111 is positioned in place immediately below the filling nozzles 103 and engaged with the vertically movable rod 121. When the rotary handle 133 is subsequently rotated, the screw rod 132 rotates, moving the movable plates 128 leftward in FIG. 13 along with the threaded member 130 which is screwed on the rod 132. This movement causes the slot portions 129 of the movable plates 128 to push up the projections 127 to thereby lift the movable rod 121 along with the liquid receptacle 111. Consequently the sockets 112 of the receptacle 111 are hermetically joined to the open lower ends of the filling nozzle 103 with the seal members 113 interposed therebetween. The liquid remaining in various portions of the filling device 15 is then discharged. Further when required, the components of the filling device 15 can be cleaned and sterilized by forcing out a cleaning solution or hot steam from the cleaning solution supply pipe 105. The solution or steam used can be discharged in the same manner as the filling liquid. Because the removal of the filling liquid and the cleaning-sterilizing operation can be carried out by moving the handles 118 and 133 with the main chamber 8 sealed off from the outside air, it is unlikely that the main chamber 8 will be contaminated with the outside air by conducting such operation.

What is claimed is:

1. A packaging machine comprising:

an endless conveyor (1);

a mandrel wheel (4) disposed above a starting end of a path of transport of the conveyor and having a plurality of mandrels (3);

a closed main chamber (8) entirely enclosing the conveyor (1) and the mandrel wheel (4), said main chamber having a top wall, a rear end, a forward end, and a bottom wall;

a series of devices (9) arranged on the top wall of the main chamber (8) from the rear ends towards the forward end for making tubular blanks C into containers by closing one end of each blank to form a bottom of the container, filling contents into the bottomed blank, and thereafter closing the other end of the blank to form the top of the container, the series of devices having portions operative on the blank C and extending into the main chamber (8); and a closed subchamber (22) disposed at the rear end of the main chamber (8) and communicating therewith and having a rear end and a forward end, said subchamber having installed therein a blank sterilizer (23) and a blank transfer assembly (24) for transferring tubular blanks C from a blank shaping-feeding unit (25) to the blank sterilizer (23) and for transferring sterilized tubular blanks C from the sterilizer (23) to the mandrel wheel (4);

said subchamber comprising a drying compartment (46) and a sterilizing compartment (49), said drying compartment having a front portion, a rear portion, and a blnak outlet (45) at said front portion communicating with the rear end of the main chamber (8), said sterilizing compartment having a front portion communicating with the rear portion of the drying compartment through a communication opening (47), a rear portion, and a blank inlet (48) at said rear portion thereof;

said blank sterilizer comprising a drying conveyor (51) disposed within the drying compartment (46), a sterilizing conveyor disposed within the sterilizing compartment (49), hot air blowing nozzles arranged along a path of transport of the drying conveyor (51), and a blank sterilizing nozzle (54) directed toward a path of transport of the sterilizing conveyor (52);

said drying conveyor (51) comprising drive and driven sprockets (55, 56) having axes of rotation spaced apart by a predetermined distance one above the other and extending in a direction aligned with said front and rear ends of said main chamber, endless chains (57) reeved around the sprockets (55, 56), and a multiplicity of drying blank holders (58) attached to the endless chains (57) at a predetermined spacing, the drying blank holders being adapted to travel through and stop at positions opposed to the blank outlet (45) and to the communication opening (47);

sterilizing conveyor (52) comprising a horizontal rotary shaft (59) extending in a direction aligned with said front and rear ends of said main chamber, and sterilizing blank holders (60) attached to said rotary shaft (59) arranged around the shaft at a predetermined spacing, the sterilizing blank holders (60) being adapted to travel through and stop at a position opposed to the communication opening (47) and to the blank inlet (48), the drying and sterilizing blank holders (58 and 60) being adapted to restrain the tubular blanks C from upward or downward movement but allow the blanks to move in a forward or rearward direction relative to the respective front and rear portions of the drying compartment and the sterilizing compartment, respectively;

said blank transfer assembly (24) comprising a plurality of pawls (79, 80, 81) movable in said forward and rearward directions at a predetermined stroke length and respectively engagable with and disengagable from blanks C held by the drying and sterilizing blank holders (58, 69) stopped at said positions.

2. A packaging machine as defined in claim 1 wherein nozzles (30, 54) for spraying a sterilizing solution are provided in a required arrangement within the main chamber (8) and the subchamber (22).

3. A packaging machine as defined in claim 1 wherein the main chamber (8) is provided with a completed container discharge opening (31) at the front end thereof and a sensor (44) for detecting the internal pressure thereof, and the subchamber (22) is provided with a blank supply opening (32) at the rear end thereof, the openings (31 and 32) being provided with openable closures (33 and 34), respectively, an air supply duct (36) extending from a clean air supply unit (35) and being connected to the main chamber (8), the air supply duct (36) being provided with a check valve (37), the clear air supply unit (35) operating in response to an output signal from the sensor (44) when the detected pressure drops below a set level.

4. A packaging machine as defined in claim 1 wherein the subchamber (22) further comprises a pressurized compartment (50) enclosing an opening of the sterilizing compartment (49) including the blank inlet (48), an air supply duct (36) being connected to the pressurized compartment (50), an air discharge duct (42) extending into the pressurized compartment (50) and being connected to the sterilizing compartment (49), whereby the pressurized compartment (50) is made to have a higher internal pressure than the sterilizing compartment (49).

5. A packaging machine as defined in claim 1 wherein the series of devices include a filling machine (15) comprising a filling liquid tank as disposed above the main chamber and a filling nozzle (103) having an upper end communicating with the filling liquid tank and a lower end extending into the main chamber (8), the filling nozzle (103) being opened at a position immediately above said endless conveyor (1); a pipe (105) for supplying sterilizing steam and cleaning solution connected to said filling liquid tank; and a liquid conduit (106) disposed below the filling nozzle (103), the liquid conduit (106) comprising a vertical portion (107) rotatably and vertically movably supported by the main chamber (8) at a location a predetermined distance horizontally away from immediately below the filling nozzle (103) and a horizontal portion (108) integral with the vertical portion (107) and having a length corresponding to the predetermined distance and a forward end, the vertical portion (107) having a lower end extending through the bottom wall of the main chamber (8) outward, the horizontal portion (108) being provided at its forward end with a liquid receptacle (111) having an upwardly open nozzle socket (112).

6. A packaging machine as defined in claim 5 wherein the vertical portion (107) of the liquid conduit (106) is provided at its upper end with a rotating rod (116) in alignment with the vertical portion (107), the rotating rod (116) having an upper end extending through and projecting upward beyond the top wall of the main chamber (8), the filling nozzle (103) being provided with a vertically movable rod (121) extending upward from its lower end and inserted through the top wall of the main chamber (8), the vertically movable rod (121) having a horizontally projecting engaging member (122) at its lower end, the liquid receptacle (111) having a U-shaped fitting portion (115) engageable with the engaging member (122) when the liquid receptacle (111) is brought to a position immediately below the filling nozzle (103).

7. A packaging machine as defined in claim 6 wherein an operation handle (118) is attached to the upper projecting end of the rotary rod (116) and a means for lifting the rod (121) is provided, the lift means comprising a rectangular tube (125) fixedly fitted on the upper projecting end of the rod (121) and provided with at least one projection (127), at least one moveable plate (128) having a slanted slot (129) with the projection (127) fitted therein and movably supported on the top wall of the main chamber (8) in a lateral direction, a threaded member (130) being held at one end of the movable plate (128), a screw rod (132) having one end screwed in the threaded member (103) and supported by a bearing (131) on the top wall of the main chamber (8), and a rotary handle (133) attached to the other end of the screw rod (132).

8. A packaging machine as defined in claim 5 wherein an annular seal member (113) of elastic material is attached to an inner periphery of each socket (112).

9. A packaging machine as defined in claim 1 wherein the horizontal rotary shaft (59) of the sterilizing conveyor (52) is rotatably supported on a partition wall between the drying compartment (46) and the sterilizing compartment (49), the rotary shaft (59) having its front end projecting into the drying compartment (46), to which end drive sprockets are fixed, the drive sprockets (69) being in mesh with said endless chains.

10. A packaging machine as defined in claim 1 wherein said pawls (79, 80, and 81) are respectively fixed to at least two rods each extending in said forward and rearward directions, the rods (77 and 78) being rotatably supported on a carriage (74) which is movable forwardly and rearwardly, means being provided for rotating the rods (77 and 78) normally or reversely so that the pawls (79, 80 and 81) engage with rear ends of the blanks C held by the drying blank holder (58) and the sterilizing blank holder (60) only when the carriage (74) moves forward.

* * * * *